US005141481A

United States Patent [19]

Kölbel

[11] Patent Number: 5,141,481

[45] Date of Patent: Aug. 25, 1992

[54] PORTABLE MUSCLE BUILDING APPARATUS

[76] Inventor: Gert F. Kölbel, Hannebuthwinkel 15, W-3000 Hannover 51, Fed. Rep. of Germany

[21] Appl. No.: 695,978

[22] Filed: May 6, 1991

[30] Foreign Application Priority Data

Feb. 22, 1991 [DE] Fed. Rep. of Germany ..... 4105624

[51] Int. Cl.[5] ..... A63B 21/02

[52] U.S. Cl. ..... 482/126; 482/121; 482/139; 482/909

[58] Field of Search ..... 272/135, 137, 139, 141, 272/DIG. 5, 143

[56] References Cited

U.S. PATENT DOCUMENTS

| | | | |
|---|---|---|---|
| 4,290,600 | 9/1981 | Kolbel | 272/143 |
| 4,376,533 | 3/1983 | Kolbel | 272/143 |
| 4,846,459 | 7/1989 | Vivian | 272/DIG. 5 |
| 4,846,462 | 7/1989 | Regnier et al. | 272/DIG. 5 |
| 4,976,427 | 12/1990 | Pantucek | 272/DIG. 5 |

FOREIGN PATENT DOCUMENTS

| | | | |
|---|---|---|---|
| 2736848 | 11/1978 | Fed. Rep. of Germany | 272/141 |

*Primary Examiner*—Richard J. Apley
*Assistant Examiner*—Lynne Reichard
*Attorney, Agent, or Firm*—Peter K. Kontler

[57] ABSTRACT

A portable muscle building and exercising apparatus wherein a helical compression coil spring is installed in a housing and can be stressed to different degrees by three loop-shaped handles two of which are to be held and pulled by the two hands and the third of which can be engaged and pulled by one or both feet of the user or affixed to a stationary part. The component which actually stresses the spring is a tensioning member having a conductive extension which can complete the circuit of a plug-shaped acoustic alarm when the spring stores a select amount of energy. The alarm can be moved to any one of a number of different positions in the path of movement of the extension of the tensioning member. The audible signal which is generated by the alarm indicates to the user that the selected degree of stress upon the spring has been reached as well as that such stress is maintained. The handles which are to be grasped by hands are connected to the ends of a variable-length rope which is trained over a pulley on the housing for the spring. When not in use, the plug-shaped alarm can be stored in a socket of the housing.

18 Claims, 3 Drawing Sheets

PORTABLE MUSCLE BUILDING APPARATUS

BACKGROUND OF THE INVENTION

The invention relates to improvements in portable muscle building and exercising apparatus, and more particularly to improvements in apparatus of the type wherein a resilient element is designed and mounted to store varying amounts of energy in the course of a muscle building and exercising operation.

Fitness centers and similar body building establishments are equipped with muscle building apparatus in the form of machines which can be set up to permit the user to carry out selected body building exercises, i.e., to exercise and strengthen selected muscles or groups of muscles. For example, a so-called armcurl extension machine is designed to exercise the muscles in the upper arms of the user. The user moves both arms to positions in which the machine offers a certain resistance to pull or traction, and the underarms are thereupon alternatively raised and lowered without altering the level of the hands. The machine comprises a weight and the level of such weight is indicative of the applied pull. Thus, in order to make sure that the level of the hands (and hence of the weight) remains unchanged, the user of the machine must continuously observe the weight while the underarms are caused to move up and down. One of the underarms is moved up while the other underarm is caused to move down, and vice versa. The thus generated pulling or traction moments are deflected by one or more pulleys or gears at a level above the weight. The just described machine is rather heavy and bulky so that it is not suitable for transport, e.g., to be taken along on trips. Moreover, the machine is expensive because it comprises a large number of rather complex and bulky parts (such as the aforementioned weight). The cost and bulk of the machine preclude its use in private homes or in apartments except if the owner of the dwelling can afford to set up a separate room for the sole purpose of accommodating the exercising machine. Still further, the machine is not sufficiently versatile, i.e., it can only be used for the exercising of certain muscles or certain groups of muscles. Additional machines must be used to exercise other muscles or groups of muscles which almost invariably limits the utilization of such machines to fitness centers and to other establishments which are normally remote from the home and, in most instances, can be used only upon payment of a fee or by belonging to a health club.

It was already proposed to employ portable muscle building apparatus which can be put to use to exercise selected muscles or groups of muscles and are, at least in part, more versatile than the aforedescribed specially designed machines A presently known portable exercising apparatus employs a housing for a spring which is adapted to be stressed to different degrees. The housing carries a device serving as a means for visually indicating the degree of stress upon the confined spring and as a means for indicating whether or not a selected stress upon the spring is maintained. The entire apparatus is sufficiently compact to be insertable into a pocket. A drawback of such portable apparatus is that the device which indicates the degree of stress as well as the duration of application of a particular stress is designed to generate optical signals, i.e., it is necessary to observe such device in order to ascertain the extent or degree of the applied stress. Continuous observation is necessary if the user of the portable apparatus wishes to ensure that the degree of stress remains unchanged or that it changes only within a selected narrow range. This limits the versatility of the apparatus or renders it less acceptable to certain users who are interested in performing the muscle building exercises under very specific circumstances, e.g., while the degree of stress which is applied to the spring varies very little or not at all. The spring is normally assembled of several rubber bands or strips, and the device which generates an optical signal when a desired degree of stress upon the spring has been reached includes a diode which lights up only when the applied stress reaches the selected value and only as long as the applied stress is not reduced below the selected value In other words, the user must look at the diode in order to ascertain the magnitude of stress upon the spring. An observation of the diode is not possible if the housing is located behind the back of the user, and such observation is equally impossible under numerous other circumstances of possible use of the just described portable exercising apparatus. A person who intends to exercise her or his muscles with the exertion of large or very large forces is particularly unlikely to be in a position or condition to continuously observe the diode rather than concentrating on the application of stresses to the spring.

OBJECTS OF THE INVENTION

An object of the invention is to provide a novel and improved portable muscle building and exercising apparatus which can furnish all necessary signals without necessitating an observation of the signal generating device or devices.

Another object of the invention is to provide an apparatus which is more versatile than heretofore known portable muscle building and exercising apparatus.

A further object of the invention is to provide the apparatus with novel and improved means for subjecting the resilient element or elements to a selected degree of stress.

An additional object of the invention is to provide an apparatus which is constructed and assembled in such a way that the user is in a better position to continuously monitor the degree of the applied stress than by utilizing a conventional apparatus.

Still another object of the invention is to provide a novel and improved signal generator for use in the above outlined portable muscle building and exercising apparatus.

A further object of the invention is to provide the apparatus with novel and improved means for varying the effective length of the means for stressing the resilient element or elements.

Another object of the invention is to provide an apparatus which is constructed and assembled in such a way that the part or parts which are detachable from its housing can be readily stored to reduce the likelihood of loss or misplacement.

SUMMARY OF THE INVENTION

The invention is embodied in a portable muscle building apparatus which comprises at least one resilient element, means for stressing the resilient element to different degrees including at least one flexible element, and means for indicating a selected degree of stress upon the resilient element. The indicating means includes an acoustic signal generator having means for generating an audible signal in response to and for the duration of the application of the selected degree of stress.

In accordance with a presently preferred embodiment, the at least one resilient element includes an elongated coil spring, and the stressing means further includes a housing for the spring, means for coupling the at least one flexible element to the housing, and means for moving one end of the spring relative to the other end and relative to the housing to thereby stress the spring when the housing is pulled by the at least one flexible element in a first direction while the moving means is pulled in a second direction substantially counter to the first direction.

The signal generating means can comprise an actuator which is movable by the moving means along a predetermined path in response to stressing of the spring, and an electric alarm which is removably insertable into the aforementioned path to generate an acoustic signal when engaged by the actuator.

The moving means can comprise a preferably U-shaped stressing or tensioning member which engages the one end of the coil spring, and a second flexible element which is connected with the stressing member. A portion of the moving means (including the second flexible element) extends from the housing so that it can be engaged and held by a foot of the user or that it can be affixed to a stationary part.

The actuator is or can be rigid (e.g., integral) with the stressing member. The alarm preferably includes electric contacts and the actuator includes means for establishing an electrical connection between the contacts. The apparatus preferably further comprises means for releasably holding the alarm in any one of a plurality of different positions in each of which the contacts are located in a different portion of the aforementioned path. The holding means can be provided with a plurality of sets of openings, and the alarm can constitute a plug the contacts of which are insertable into and withdrawable from a selected set of openings. For example, the plug can be provided with two contacts, and each set then comprises two openings. The holding means can comprise a substantially U-shaped guide having two legs which flank the path for the actuator, and the aforementioned sets of openings are provided in at least one leg of the guide. At least the at least one leg of the guide is made of a suitable electrically insulating material, and the guide is or can be affixed to the housing. The arrangement is or can be such that the guide is installed in the housing and the housing is then provided with openings which register with the openings in the at least one leg of the guide.

The housing can be provided with a facility for temporary storage of the alarm when the alarm is removed from the aforementioned path. Such facility can include a socket, and the alarm is preferably dimensioned to be a slight press fit in the socket. This ensures that the alarm is reliably held in the socket and that it can be extracted from the socket with the exertion of a relatively small force.

The aforementioned coupling means can include a pulley which is rotatably carried by the housing, and the at least one flexible element is then trained over the pulley and includes a first end and a second end. Such stressing means can further comprise two handles, one for each end of the at least one flexible element, and a cable or rope reel on each handle. Each end of the at least one flexible element is connected to a different reel, and each reel serves to store a selected length of the at least one flexible element at the respective end of the at least one flexible element. Each reel can be provided with a hook or other suitable means for releasably clamping the stored selected length of the at least one flexible element. Each reel can have a double T-shaped profile, and each handle can include a flexible loop.

The at least one resilient element can comprise or constitute a helical coil compression spring.

The novel features which are considered as characteristic of the invention are set forth in particular in the appended claims. The improved muscle building apparatus itself, however, both as to its construction and the mode of using the same, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
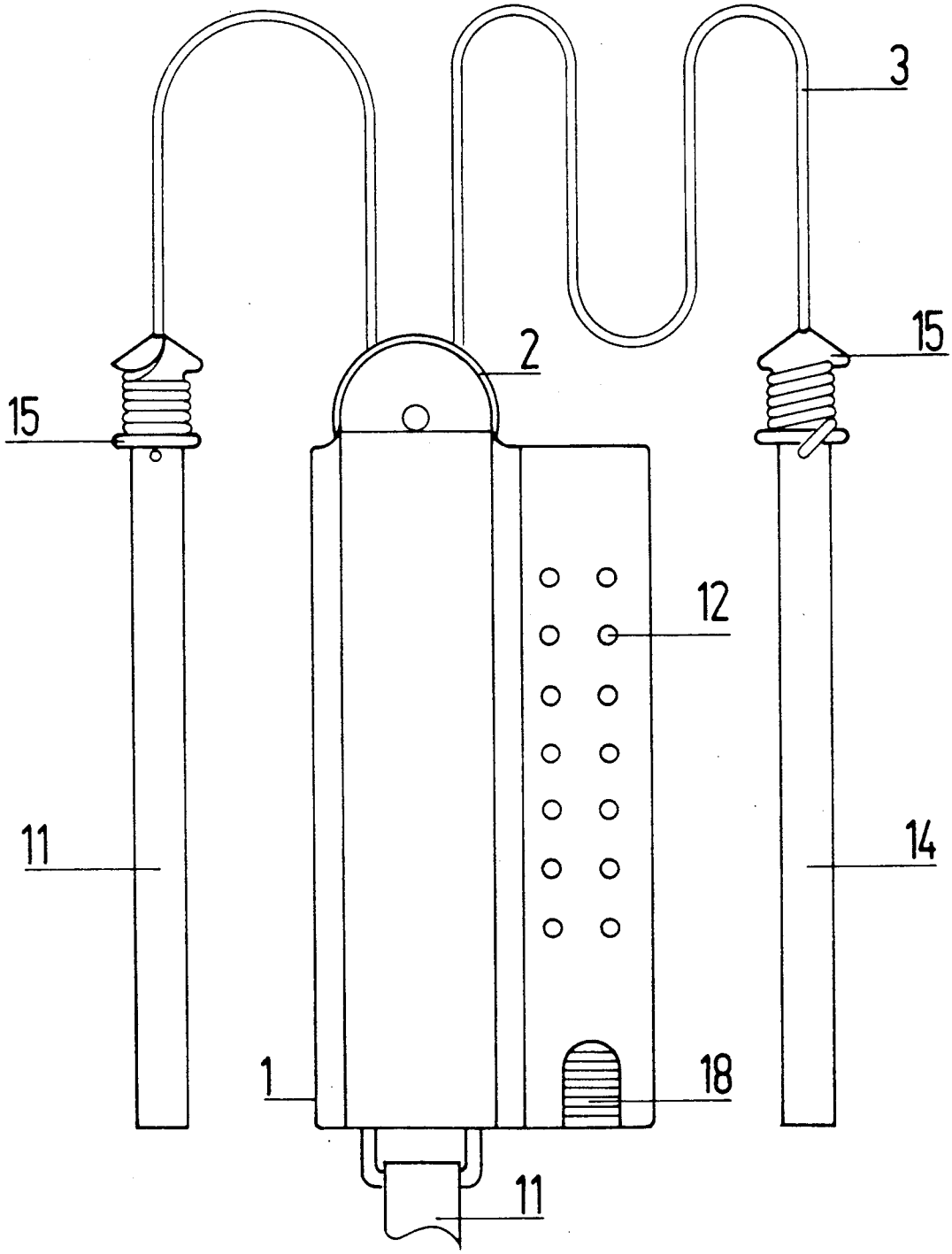
FIG. 1 is a schematic elevational view of a muscle building and exercising apparatus which embodies one form of the invention, the alarm of the acoustic signal generator being confined in its socket and the at least one flexible element being partially convoluted onto the reels which connect it with the respective handles.
Figure 2:
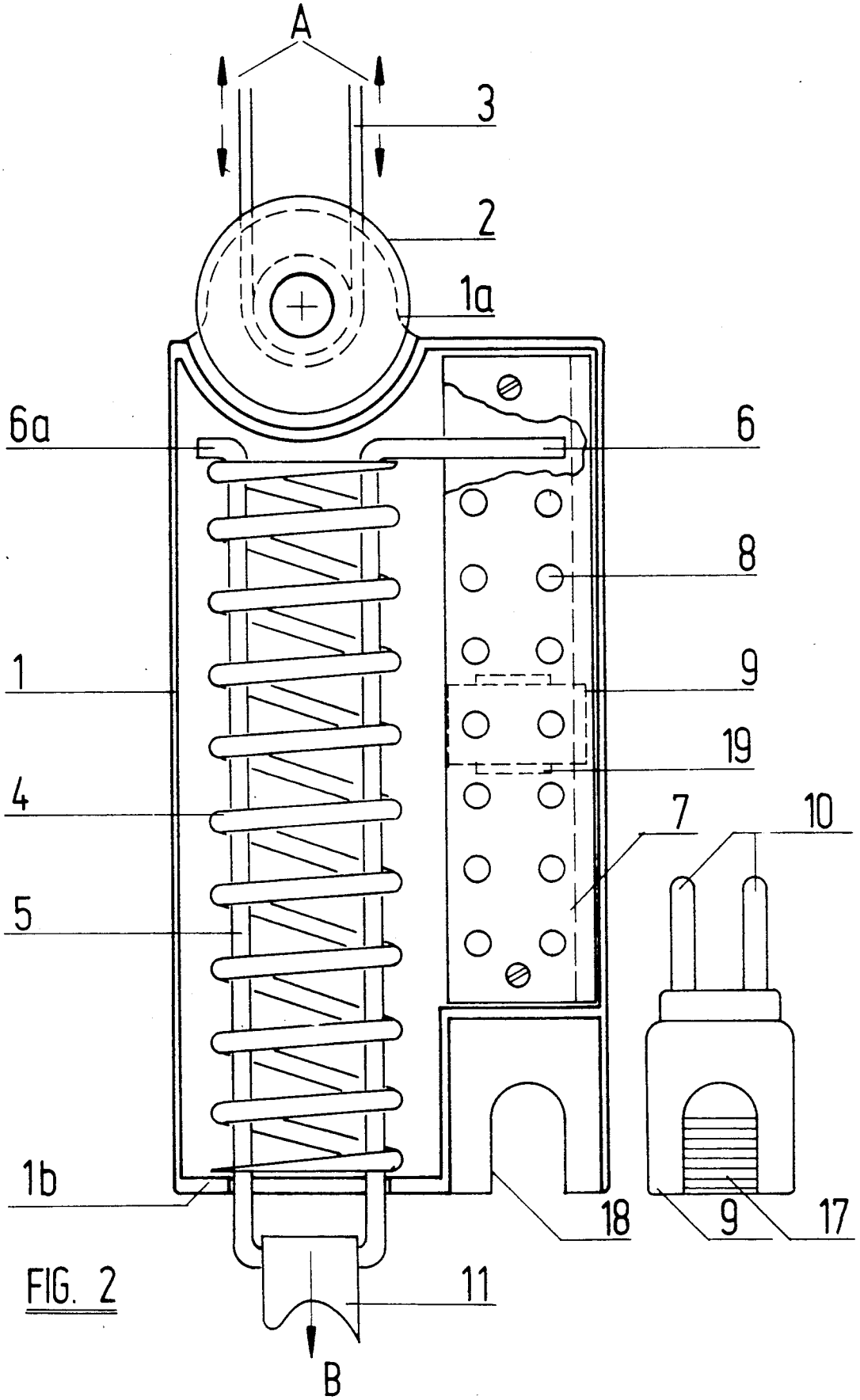
FIG. 2 is an enlarged view of a portion of the apparatus, the front section of the housing being removed and the alarm of the acoustic signal generator being adjacent the socket.
Figure 3:
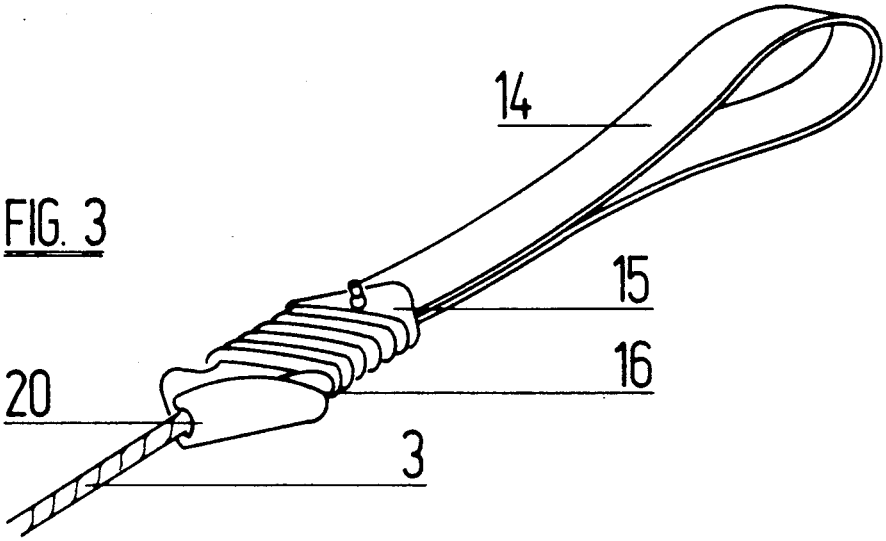
FIG. 3 is a perspective view of one reel for the at least one flexible element.

Referring first to FIGS. 1 and 2, the improved portable muscle building apparatus comprises basically at least one resilient element (here shown in the form of an elongated helical coil compression spring 4), means (including at least one elongated flexible element 3 here shown as a cable, cord or rope and hereinafter called rope for short) for stressing the spring 4 to different degrees, and means (including an actuator 6 and an acoustic signal generator in the form of a plug-shaped alarm 9) for indicating a selected degree of stress upon the spring 4. In accordance with a feature of the invention, the alarm 9 comprises means (such as a standard electric buzzer in a plastic casing) for generating an audible signal in response to and for the duration of the application of the selected degree of stress.

The means for stressing the spring 4 further comprises a composite (e.g., two-piece) housing 1 for the spring, a flat pulley or sheave 2 which is mounted in and extends in part from the housing 1, and means for moving one end of the spring 4 (namely the upper end as seen in FIG. 2) relative to the other (lower) end and relative to the housing 1 to thereby stress the spring 4 when the rope 3 is manipulated to pull the housing 1 in one direction (arrows A in FIG. 2) and the moving means is pulled in a second direction (arrow B in FIG. 2) substantially counter to the first direction. The moving means comprises a substantially U-shaped tensioning or stressing member 5 which engages the one end of the spring 4 and extends through a reinforced end wall lb of the housing 1, and a flexible loop-shaped element or handle 11 which is affixed to the member 5 at the exterior of the housing. The housing 1 further comprises two projections la (only one shown) at opposite sides of the pulley 2. The rope 3 is trained over the pulley 2 and its ends are connected (by rope reels 15) to two flexible loop-shaped handles 14.

Figure 4:
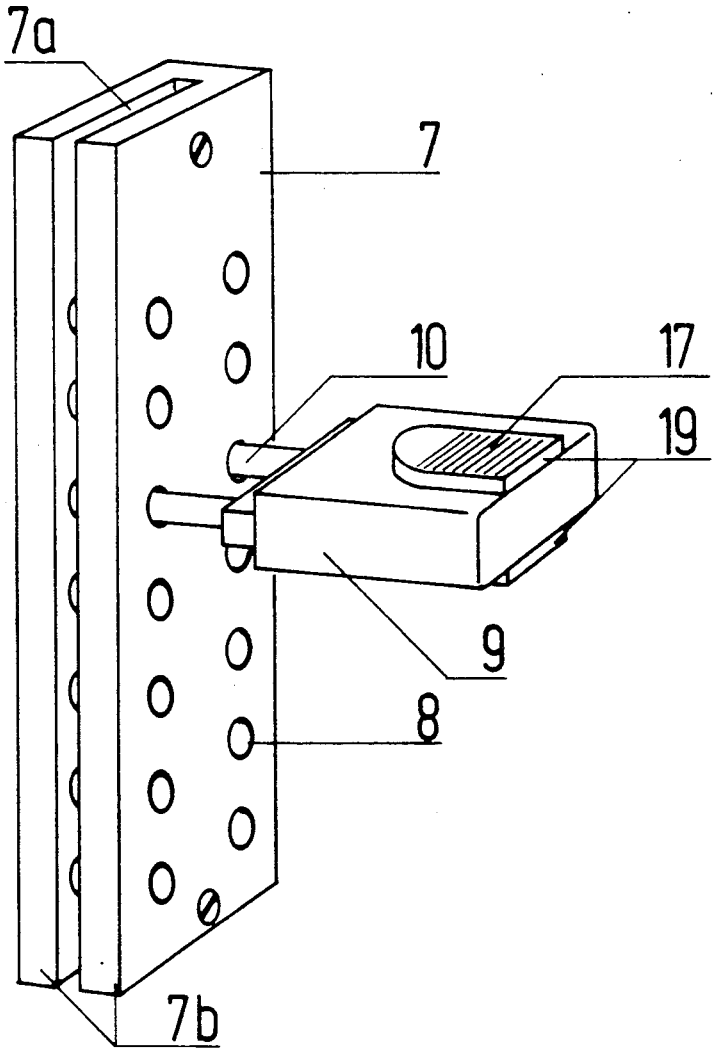
FIG. 4 is a perspective view of the insulating guide for the actuator of the acoustic signal generator and a perspective view of the alarm in a selected position relative to the path for the actuator.

The spring 4 is preferably made of steel wire and is confined in the interior of the housing 1, the same as the major part of the U-shaped stressing member 5 which includes an extension 6 constituting an actuator for the alarm 9. At least the actuator 6 is made of a current conducting material. The one end of the spring 4 is engaged by the extension or actuator 6 and by a second extension 6*a* of the stressing member 5, and the other end of the spring 4 bears against the reinforced end wall 1*b* of the housing 1. The member 5 can be made of cylindrical steel bar stock and its extensions 6, 6*a* establish a reliable form-locking connection with the adjacent end convolution of the spring 4. Thus, when the housing 1 is pulled in the direction of the arrow B (through the medium of the handle 11, stressing member 5 and spring 4), while the handles 14 are pulled in the direction of arrows A, the extensions 6, 6*a* move the adjacent end of the spring 4 toward the reinforced end wall 1*b* whereby the spring is stressed to a desired degree. The degree of stress upon the spring 4 is proportional with the extent of movement of the extension or actuator 6 along an elongated path which is defined by the parallel flat legs 7*b* of an elongated holding device or guide 7 which is installed in the housing 1 adjacent the spring 3. At least a portion of the guide 7 is made of an electrically insulating material and at least one of the legs 7*b* is formed with several sets (pairs) of aligned openings 8 for the electric contacts 10 of the alarm 9. FIG. 4 shows that each of the two legs 7*b* can be provided with several sets of openings 8 so that, when the contacts 10 are inserted into a set of pair of openings 8 in one of the legs 7*b*, such contacts can extend across an elongated slot 7*a* between the legs 7*b* and into the aligned openings 8 of the other leg. This locates the contacts 10 in a selected portion of the path (slot 7*a*) for movement of the actuator 6 to a position which is indicative of the selected degree of stress upon the spring 4.

The buzzer in the alarm 9 produces an audible signal as soon as the actuator 6 engages the contacts 10 in the slot 7*a*, and the buzzer continues to produce the audible signal as long as the actuator 6 continues to establish an electrical connection between the contacts 10. Thus, the user of the improved muscle building apparatus knows whether or not the selected or desired degree of stress upon the spring 4 is maintained as well as the duration of maintenance of the selected degree of stress. This holds true irrespective of whether or not the user can look at the housing 1 and/or at the selected position of the plug-shaped alarm 9 relative to the housing. The latter has a set of openings 12 each of which registers with an opening 8 in the adjacent leg 7*b* of the guide 7. The exterior of the housing 1 can be provided with indicia (not shown) denoting that degree of stress upon the spring 4 which has been reached when the contacts 10 are inserted into and through a selected set or pair of openings 12 and the alarm 9 is in the process of producing an audible signal.

The housing 1 is provided with a facility (here shown as a socket 13) for temporary storage of the plug-shaped alarm 9 when the latter is not in use, i.e., when its contacts 10 are not inserted into a set of openings 12 in the housing. The arrangement is preferably such that the alarm 9 is a slight press fit in the socket 13 so that it is unlikely to be disengaged during normal manipulation of the apparatus when the latter is not in actual use but that it can be extracted from the socket 13 with the exertion of a relatively small force. In order to facilitate its manipulation, the casing of the alarm 9 is preferably provided with two raised platforms 19 having parallel serrations 17. The housing 1 has a cutout or recess 18 which communicates with the socket 13 and affords access to the serrations 17 when the plug-shaped alarm 9 is confined in the socket.

Each of the reels 15 has a double T-shaped profile and each of these reels can store a selected (surplus) length of the rope 3 at the respective end of the rope. Furthermore, the reels 15 are provided with hooks 16 or analogous means for releasably clamping the adjacent portions of the rope 3 to thus ensure that the stored (convoluted) lengths of the rope cannot be unwound when the apparatus is in actual use. The hooks 16 define notches which can receive the adjacent portions of the rope 3 with a substantial amount of friction to thus prevent uncontrolled unwinding of convoluted lengths of the rope from the respective reels 15. Each reel 15 is further provided with a claw-shaped guide portion 20 which locates the adjacent unwound portion of the rope 3 in an optimum position relative to the respective (preferably loop-shaped) handle 14.

The improved apparatus can be utilized to exercise and strengthen selected muscles or groups of muscles in a number of different ways. The exercises can be carried out without the need to continuously or repeatedly observe the housing 1 as is necessary in heretofore known apparatus in order to ascertain whether or not the desired or selected degree of stress upon the spring has been reached. This is due to the fact that the alarm 9 produces an audible signal as soon as the actuator 6 engages the electric contacts 10 and that the alarm 9 continues to produce such acoustic signal as long as the actuator 6 continues to engage the contacts 10. Thus, the two hands of the user can grasp the handles 14 and one foot of the user can be inserted into and can hold the loop-shaped handle 11 while the housing 1 is located behind the back of the user. By exerting a pull upon the handles 14 in a direction having a component in the direction of arrows A (while the handle 11 pulls the housing 1 in the direction of arrow B), the user simply increases the pull upon the handles 14 until the alarm 9 responds by producing an audible signal. At such time, the extensions 6, 6*a* then pull the adjacent end convolution of the spring 4 toward the other end convolution which bears against the end wall 1*b* of the housing 1. The extension or actuator 6 moves along its path in the slot 7*a* between the legs 7*b* of the guide 7 and establishes an electrical connection between the contacts 10 as soon as the actuator enters the selected portion of its path, namely that portion which has been selected by the user who has inserted the contacts 10 into a selected pair or set of openings 12 in the housing 1, i.e., into selected sets of openings 8 in the legs 7*b*.

The handle 11 can be located at a level above the housing 1 if the user of the apparatus elects to exercise her or his muscles while lying on the ground and while the handle 11 is affixed to an overhead support, to the foot of a raised leg or to the feet of two raised legs.

FIG. 2 shows an intermediate position of the alarm 9 and of its contacts 10 by broken lines. The alarm 9 can be placed closer to the socket 13 or closer to the pulley 2, depending on the desired degree of stress upon the spring 4 when the alarm is to produce an audible signal. An interruption or termination of signal generation indicates to the user that the selected degree of stress upon the spring 4 no longer exists, i.e., that the actuator 6 has been permitted to migrate away from the socket 13 under the action of the spring.

The effective length of the rope 3 (between the two reels 15) depends upon the size of the user and upon the nature of the elected exercise. Such effective length can be readily and rapidly changed by winding an additional length of rope 3 onto or by unwinding a certain length of rope from the one and/or the other reel 15. Once a selected effective length has been chosen, those portions of the rope 3 which are adjacent the hooks 16 are clamped to the respective reels 15 and the claw-shaped guides 20 ensure that the ends of the non-convoluted length of the rope are properly oriented with reference to the adjacent handles 14. As a rule, the guides 20 maintain the adjacent ends of the non-convoluted length of the rope in or close to the planes of adjacent portions of the respective handles 14.

The dimensions or capacities of the reels 15 can be selected in such a way that the reels can jointly store the entire rope 3 when the improved apparatus is to be out into storage. At such time, the plug-shaped alarm 9 is preferably detached from the guide 7 and is inserted into the socket 13. This ensures that the apparatus occupies a minimal amount of space when it is not in use. The collapsed apparatus can be taken along on trips in a suitcase, bag or other suitable receptacle and can be set up for use within a very short interval of time. All that is necessary is to unwind a selected length of rope 3 from the one and/or the other reel 15, to withdraw the alarm 9 from its socket 13, and to insert the contacts 10 into a selected set of openings 12 in the housing 1.

The exact nature of the buzzer in the alarm 9 forms no part of the invention. The casing of this alarm provides room for one or more replaceable batteries or other suitable sources of electrical energy. If desired, the improved apparatus can be furnished with two or more alarms 9 each of which can generate a different acoustic signal.

An important advantage of the improved apparatus is that the user need not concentrate upon the observation of the housing 1 or any other part of the apparatus because such user can discern the audible signal irrespective of whether or not the housing 1 and/or any other parts of the apparatus are observable in the course of an exercise. Moreover, the provision of an acoustic signal generator enhances the versatility of the apparatus because it can be put to uses which involve locating the housing 1 in positions wherein the housing is not visible to the eyes of the user of the apparatus.

An advantage of an energy storing element in the form of a coil spring is that the characteristic curve of such spring can be ascertained with a high degree of precision so that it is possible to select the desired degree of stress upon the spring with a very high degree of accuracy. Moreover, the improved apparatus is simple, compact and rugged so that it can stand long periods of use under circumstances which involve the application of pronounced stresses.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A portable muscle building apparatus comprising at least one resilient element including an elongated coil spring; means for stressing said element to different degrees including at least one elongated flexible element, a housing for said spring, means for coupling said at least one flexible element with said housing and means for moving one end of said spring relative to the other end and relative to said housing to thereby stress said spring when said housing is pulled by said flexible element in a first direction and said moving means is pulled in a second direction substantially counter to said first direction; and means for indicating a selected degree of stress upon said resilient element, including an acoustic signal generator having means for generating an audible signal in response to and for the duration of application of the selected degree of stress, said signal generating means comprising an actuator which is movable by said moving means along a predetermined path in response to stressing of said spring, and an electric alarm which is removably insertable into a selected portion of said path to generate an audible signal when engaged by said actuator.

2. The apparatus of claim 1, wherein said moving means comprises a substantially U-shaped stressing member which engages said one end of said spring, and a second flexible element connected with said stressing member, a portion of said moving means extending from said housing.

3. The apparatus of claim 1, wherein said moving means includes a stressing member which engages said one end of said spring, said actuator being rigid with said stressing member.

4. The apparatus of claim 3, wherein said alarm includes electric contacts and said actuator includes means for establishing an electrical connection between said contacts.

5. The apparatus of claim 4, further comprising means for releasably holding said alarm in any one of a plurality of different positions in each of which said contacts are located in a different portion of said path.

6. The apparatus of claim 5, wherein said holding means has a plurality of sets of openings for said contacts and said alarm constitutes a plug the contacts of which are insertable into and withdrawable from a selected set of openings

7. The apparatus of claim 6, wherein said plug has two contacts and each of said sets comprises two openings.

8. The apparatus of claim 6, wherein said holding means includes a U-shaped guide having two legs flanking the path for said actuator, said sets of openings being provided in at least one of said legs.

9. The apparatus of claim 8, wherein at least said at least one leg consists of an electrically insulating material and said guide is affixed to said housing.

10. The apparatus of claim 8, wherein said guide is installed in said housing and said housing has openings in register with the openings of said at least one leg.

11. The apparatus of claim 1, wherein said housing is provided with a facility for temporary storage of said alarm when said alarm is removed from said path.

12. The apparatus of claim 11, wherein said facility includes a socket and said alarm is dimensioned to be a press fit in said socket.

13. The apparatus of claim 1, wherein said coupling means includes a pulley which is rotatably carried by said housing and said at least one flexible element is trained over said pulley and includes a first end and a second end, said stressing means further comprising two handles, one for each end of said at least one flexible element, and a reel on each of said handles, each end of said at least one flexible element being connected to a different one of said reels and each reel being arranged to store a selected length of said at least one flexible element at the respective end thereof.

14. The apparatus of claim 1, wherein said at least one resilient element comprises a helical coil compression spring.

15. A portable muscle building apparatus comprising at least one resilient element including an elongated coil spring; means for stressing said element to different degrees including at least one elongated flexible element, a housing for said spring, means for coupling said at least one flexible element with said housing, and means for moving one end of said spring relative to the other end and relative to said housing to thereby stress said spring when said housing is pulled by said flexible element in a first direction and said moving means is pulled in a second direction substantially counter to said first direction, said coupling means including a pulley which is rotatably carried by said housing and said at least one flexible element being trained over said pulley and including a first end and a second end, said stressing means further comprising two handles, one for each end of said at least one flexible element, and a reel on each of said handles, each end of said at least one flexible element being connected to a different one of said reels and each reel being arranged to store a selected length of said at least one flexible element at the respective end thereof; and means for indicating a selected degree of stress upon said resilient element, including an acoustic signal generator having means for generating an audible signal in response to and for the duration of application of the selected degree of stress.

16. The apparatus of claim 15, wherein each of said reels comprises means for releasably clamping the stored selected length of said at least one flexible element.

17. The apparatus of claim 15, wherein each of said reels has a double T-shaped profile.

18. The apparatus of claim 15, wherein each of said handles includes a flexible loop.

* * * * *